United States Patent [19]

Althammer

[11] 4,244,197

[45] Jan. 13, 1981

[54] METHOD AND APPARATUS FOR PRODUCING KNIT FABRIC

[75] Inventor: Klaus P. Althammer, Spartanburg, S.C.

[73] Assignee: Sulzer Brothers Limited, Spartanburg, S.C.

[21] Appl. No.: 73,893

[22] Filed: Sep. 10, 1979

[51] Int. Cl.[3] ..... D04B 9/06

[52] U.S. Cl. ..... 66/19; 66/57; 66/190

[58] Field of Search ..... 66/17, 19, 20, 22, 31, 66/38, 12, 190, 25, 57, 42 R

[56] References Cited

U.S. PATENT DOCUMENTS

| | | | |
|---|---|---|---|
| 3,490,252 | 1/1970 | Paepke et al. | 66/57 |
| 3,681,941 | 8/1972 | Burdett | 66/19 |
| 3,874,197 | 4/1975 | Plath | 66/12 |
| 3,986,374 | 10/1976 | Fane | 66/190 |

FOREIGN PATENT DOCUMENTS

| | | | |
|---|---|---|---|
| 2346383 | 3/1974 | Fed. Rep. of Germany . | |
| 2454562 | 6/1975 | Fed. Rep. of Germany | 66/190 |

*Primary Examiner*—Ronald Feldbaum
*Attorney, Agent, or Firm*—Luke J. Wilburn, Jr.; Wellington M. Manning, Jr.

[57] ABSTRACT

Method and apparatus for knitting fleece fabrics on a knitting machine having two sets of needles disposed for movement in planes disposed at angles to each other to form a fabric construction; and wherein one set of needles is employed exclusively to knit a jersey ground construction from relatively lightweight yarns, while selected of the other set of needles are employed with selected needles of said one set to inlay a much heavier yarn along selected courses to pass alternately over and be tucked under groups of one or more consecutive wales of the knit ground construction without forming stitches therein. The heavy inlay yarns are drawn by the selected needles of the other set to appear primarily on one face of the fabric, and these selected needles which hold the inlay yarn are retracted to less than full welt position to dispose the inlaid yarn below the plane of knitting movement of certain of the needles of said one set.

On double knit machines employing two sets of latch needles, a latch opener is provided for opening the latches of the selected needles of said other set to receive the heavy yarn in the hooks thereof. After the knitting cycle, the inlay yarn is released from the selected needles into the courses of the knit ground without forming stitches therein.

15 Claims, 4 Drawing Figures

METHOD AND APPARATUS FOR PRODUCING KNIT FABRIC

This invention relates to method and apparatus for producing a single knit fabric construction, and, more particularly, to method and apparatus for producing a single knit jersey fleece fabric on a multi-feed double knit knitting machine having two sets of needles disposed for movement at angles to each other to form a fabric construction.

BACKGROUND OF THE INVENTION

Fleece fabrics generally comprise a single jersey knit ground construction having a plurality of heavier unknitted inlaid yarns tucked into the ground yarns to extend along the courses alternately to appear in front and be tucked into wales of the ground yarns. Such fabrics are employed for various end uses, such as in wearing apparel, upholstery, and the like. The heavy inlaid fleece yarns of the fabrics generally appear predominantly on one face of the knit ground construction, provide dimensional stability, and give the fabric the appearance of heavier woven woolen cloths. In the past, such fabrics have been knitted on circular single knit jersey knitting machines employing a single set of needles with corresponding sinkers.

It is known to produce double knit fabrics having inlaid yarns on a double knit machine by direct inlay of the yarns between the cylinder and dial needles with resulting placement between the two faces of the fabric; however, such inlay yarns are not generally effectively locked into the knit construction and may be removed by pulling the inlaid yarn ends in course-wise direction. It is also known to produce a plush type fabric on a circular double knit machine by knitting both a ground yarn and a plush, or surface effect, yarn on one set of latch needles, while employing a special set of reverse hook spring needles to extend the length of the plush loops on one face of the fabric as they are knit into the ground construction. Such a double knit machine arrangement is described in U.S. Pat. No. 3,874,197. However, such fabrics having knitted-in plush yarns, or other yarns knitted or laid therein, are quite limited in their construction because of the size of yarns which can be effectively accommodated on the particular needle spacing or cut, i.e., needles per inch, which most double knit knitting machines possess. Double knit knitting machines employed to knit double knit fabrics generally utilize cuts ranging from 6 to 40 needles per inch, with 18 cut being the more prevalent double knit machine needle spacing. Thus, for a particular cut, or needle spacing, of a circular knit machine, the machine can accommodate yarns to be knitted on the needles only within a narrow range of sizes. If a large or heavy yarn is attempted to be employed in the knitting operation, many knitting problems arise. If the yarn is too thick for the needle spacing of the machine, it can put great strain on the knitting elements causing excessive wear or breakage of the needles, breakage of the yarn, and excessive wearing of the cams and yarns carriers, particularly when the needles handling the yarns are moved to welt, or fully retracted positions. Fabric quality is also effected when yarns too thick or too thin for the cut of the machine are employed, with resultant holes, drop stitches and end outs occurring in the fabric during the knitting operation.

To accommodate larger and heavier inlay yarns on a double knit machine, it has recently been proposed to knit double knit fabrics having heavy, contrasting pattern effect yarns inlaid and sandwiched between the front and back faces of the fabric by use of an attachment having a plurality of rotatable, radially extending blades which intermesh with the cylinder or dial needles of the machine to feed and locate an inlay yarn alternately in front of and behind the set of needles on which one face of the double knit fabric is knitted. The attachment is mounted on the cylinder or dial and is driven in rotation by a gear portion which is engaged by the shanks of the cylinder or dial needles, respectively, and special needle control cams are employed to tuck the heavier inlaid yarns into the knitted ground fabric. Such attachments and their manner of use in double knit machines are variously described in German Pat. Nos. 2,346,383 and 2,454,562, and U.S. Pat. No. 3,986,374. Although the rotating wheel attachment does permit introduction of heavy inlaid yarns into fabrics made on a double knit machine, the attachment is a relatively complicated device and the attachment and machine modifications incident to its use add considerable expense to the knitting operation.

OBJECTS OF THE INVENTION

It is therefore an object of the present invention to provide method and apparatus for knitting fleece fabrics having relatively large and heavy inlay yarns therein on a knitting machine employing two sets of needles without the necessity of expensive attachments or extensive modifications of the knitting machine.

It is another object to provide a method of knitting fleece fabrics having a jersey knit ground construction and a relatively heavy inlay yarn disposed along the courses of the ground construction to pass alternately over and be tucked under wales thereof by use of two sets of standard needles themselves to tuck and thereby effectively lock the heavier yarns in the ground construction without forming stitches in the inlay yarn.

It is another object to provide an improved double knit knitting machine of the conventional cylinder and dial needle cut which can be readily employed to knit fleece fabrics having heavy inlaid yarns of the type described.

It is still a further object to provide a double knit knitting machine for knitting fleece fabrics with minimum modification of the machine and corresponding less expense for the knitting operation.

BRIEF DESCRIPTION OF THE DRAWINGS

The above as well as other objects of the invention will become more apparent from the following detailed description of a preferred embodiment of the invention, when taken with the accompanying drawings, in which.

BRIEF SUMMARY OF THE INVENTION

The present invention in its broad aspects comprises method and apparatus for knitting fleece fabrics on a knitting machine employing two sets of standard needles disposed in angular relation for extended and retracted movement by control means. The lightweight jersey knit ground construction is knitted exclusively on one set of needles, and selected of the other set of needles are employed with selected needles of said one set to inlay a much heavier yarn along the courses so that it extends alternately over and tucks under groups of one or more consecutive wales of the knit ground construction in selected courses without forming stitches therein. More specifically, needle control means, such as cams, are provided for controlling the sequence of movement of the set of needles employed solely to inlay the yarn relative with the movement of the set on which the jersey ground construction is being knitted. Selected needles of the two sets function to effectively lock the heavy inlay yarn into the knit ground construction without forming stitches in the heavy yarn so that it appears predominantly on one face of the fabric, and without break out of the yarns, excessive wear or breakage of the needles, or resultant off quality of the knitted fabric construction.

DETAILED DESCRIPTION OF PREFERRED EMBODIMENTS

Figure 1:
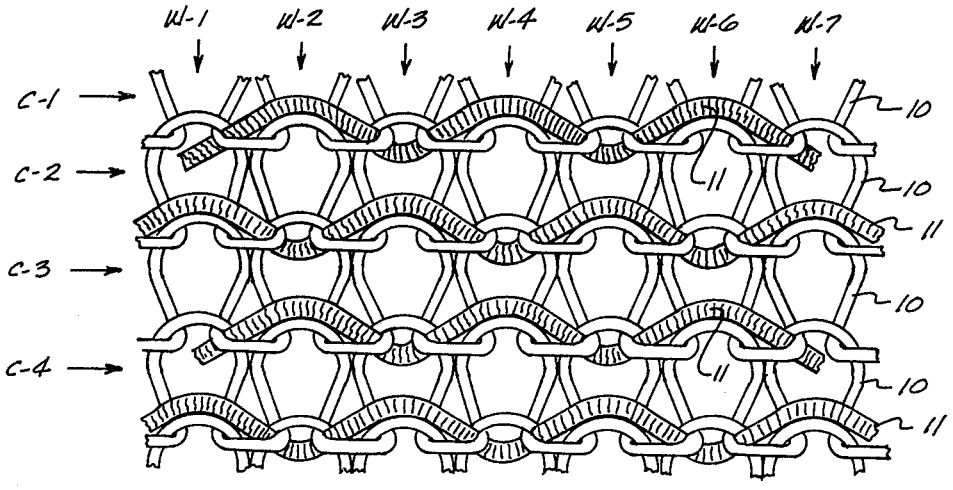
FIG. 1 is a schematic loop drawing of a typical fleece fabric construction which may be knit by the method and apparatus of the present invention.

Referring more specifically to the drawings, FIG. 1 illustrates a loop stitch diagram of a portion of the technical back of one type of fleece fabric construction which may be knitted in accordance with the method and apparatus of the present invention. As seen, the fabric is composed of a single knit jersey ground construction knitted exclusively on one set of needles of a double knit machine in a plurality of courses, C-1 through C-4, and wales, W-1 through W-7. The knitted ground construction is typically formed of a relatively lightweight yarn 10, the size of which is selected for ready accommodation and knitting on the particular gauge, or cut, of the double knit machine employed in the knitting operation. Typically on an 18 cut machine, the ground construction may be composed of synthetic yarns of a denier size of between about 70 and 150.

As further shown in FIG. 1, disposed along the courses and extending over and being tucked under every other wale of the knitted ground construction in each course is a relatively heavy inlay yarn 11, the size, weight, and particular types of which may be widely varied depending upon the particular appearance desired in the fleece fabric. Because the inlaid yarns are tucked into alternate wales of the knitted ground construction, they are effectively locked and held in the ground construction, without the necessity of forming stitches therein. Although in the construction illustrated in FIG. 1, the inlaid yarns pass alternately over and are tucked under every adjacent wale of the fabric, with the inlaid yarns in adjacent courses being spaced out of phase by one wale to form a generally uniform surface appearance in the fleece fabric, the inlaid yarns can be placed by the method and apparatus of the present invention to pass alternately over and tuck under adjacent groups of one or more consecutive wales during progression along the courses, if desired, and as will be explained. Similarly, the heavy yarns need not be inlaid in every course of the fabric, but may be located only in selected courses to vary the surface appearance of the fleece fabric, as will become apparent from the following detailed description of the method and apparatus of the present invention.

Figure 2:
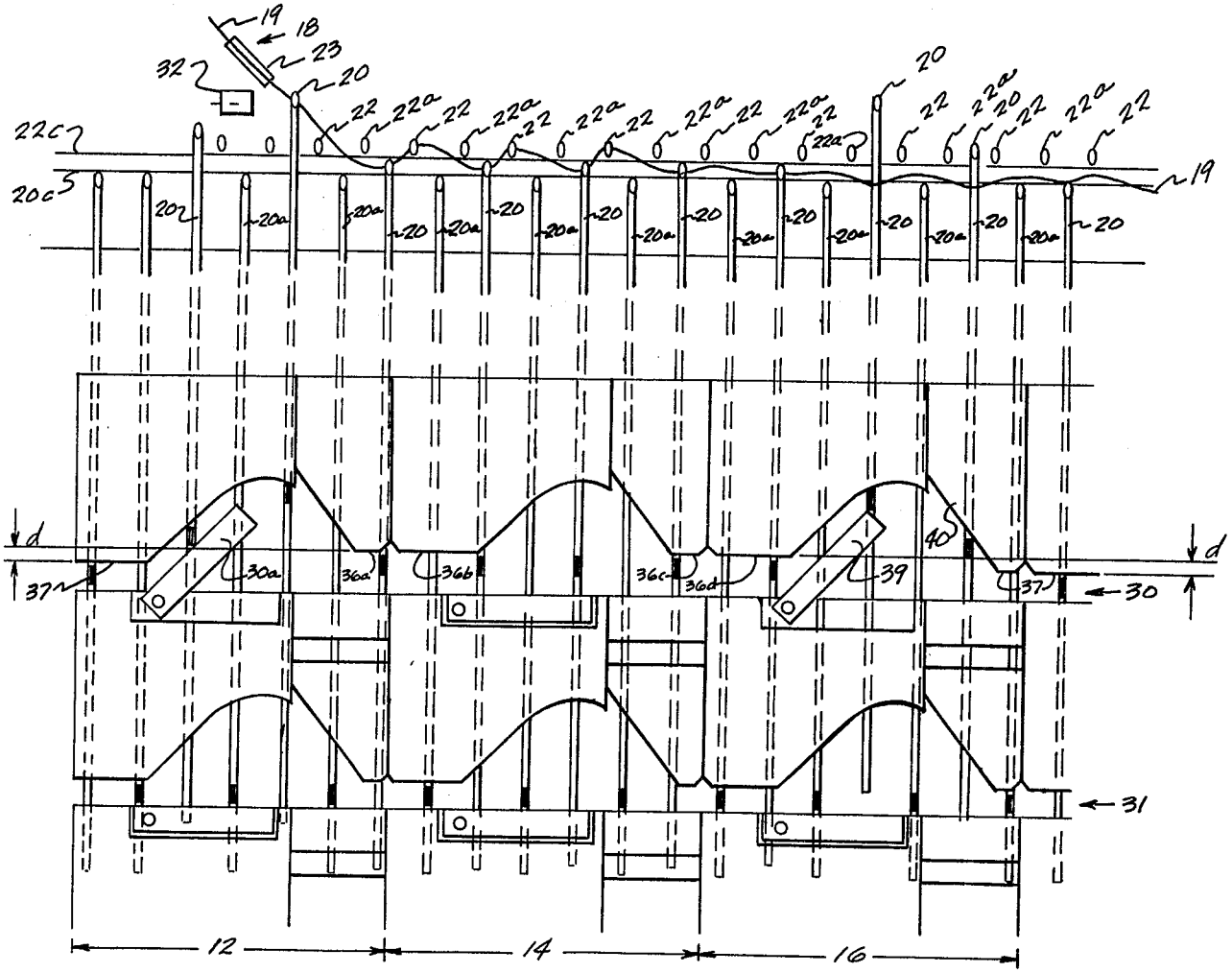
FIG. 2 is a schematic side view representation of a portion of the cylinder latch needle set, with accompanying needle control cam tracks, of a circular double knit knitting machine employed for knitting fleece fabrics in accordance with the present invention.
Figure 3:
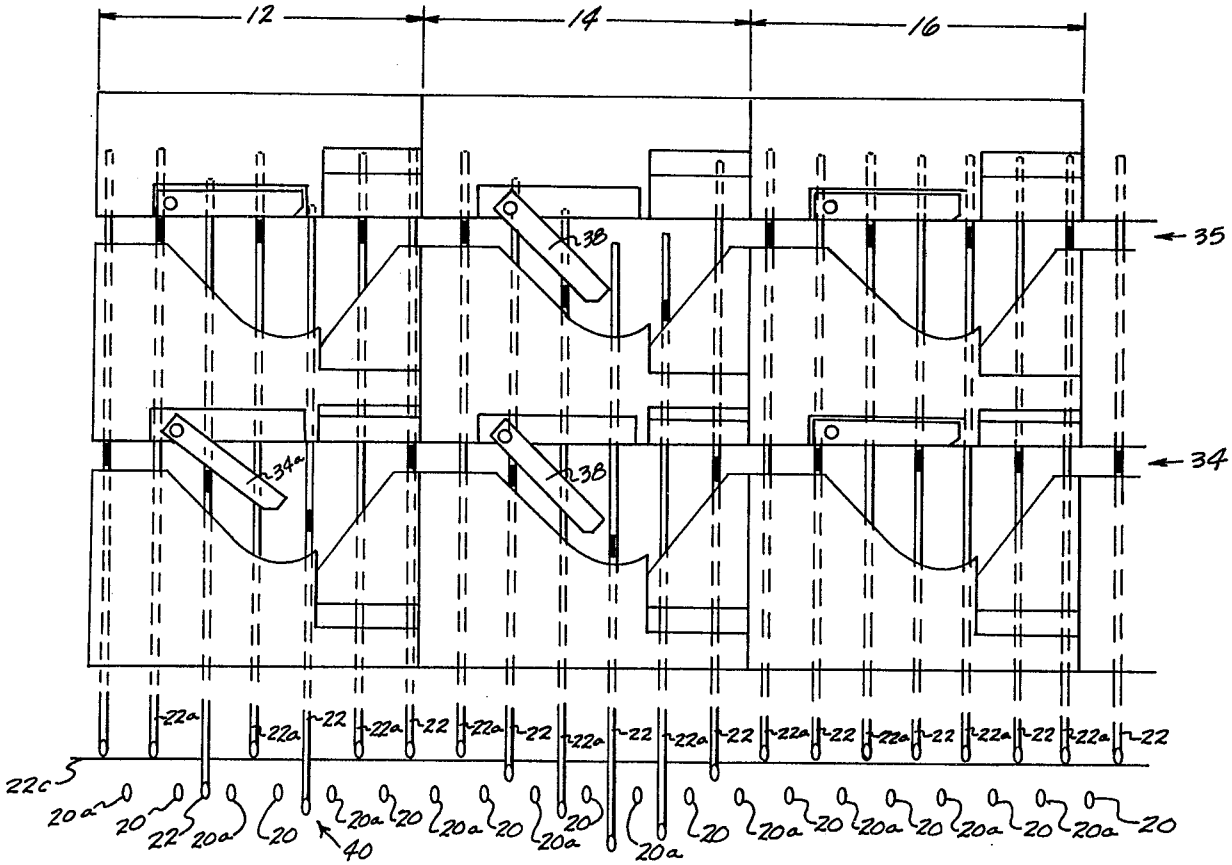
FIG. 3 is a schematic plan, or top, view representation of a corresponding portion of the dial latch needle set and accompanying control cam tracks of the circular double knit machine.
Figure 4:
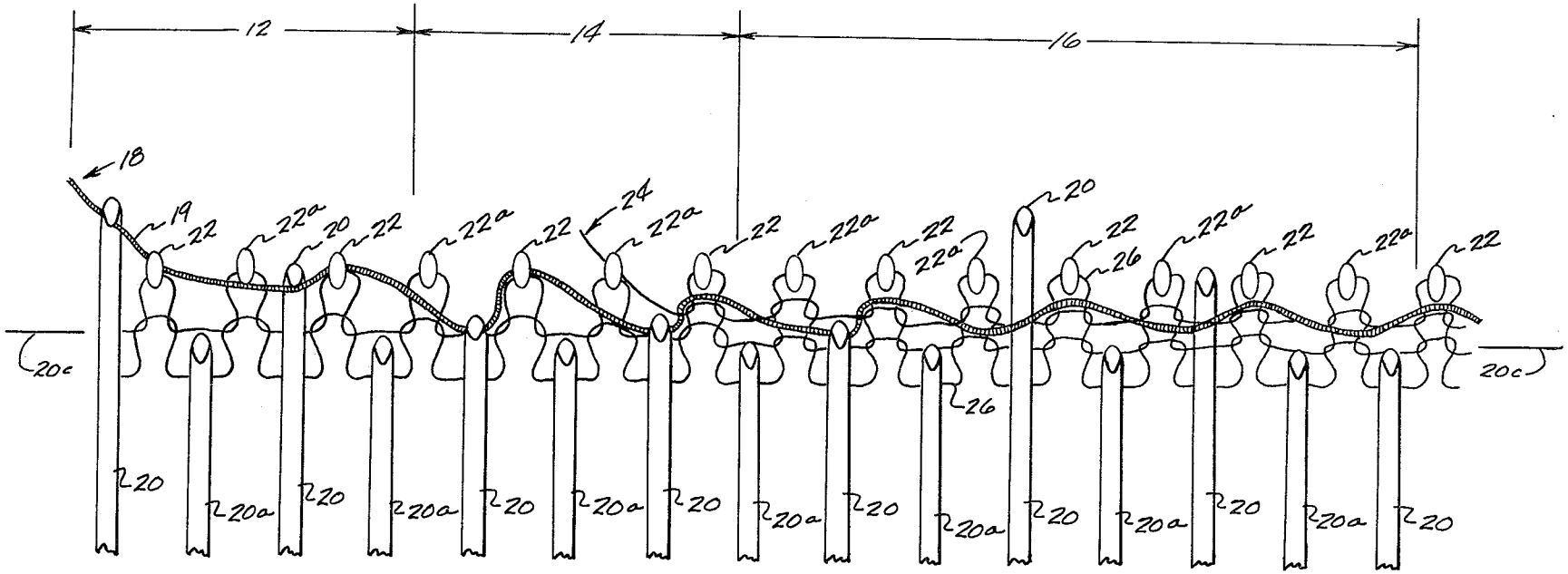
FIG. 4 is an enlarged schematic side elevation view of a portion of the sets of cylinder and dial needles, illustrating the manner in which the heavy inlay yarn is engaged by the needles for incorporation into the ground fabric construction of the fleece fabric.

FIGS. 2-4 illustrate schematically the method and apparatus of the present invention as practiced to form the fabric construction of FIG. 1 on a circular double knit machine having a set of cylinder and dial latch needles disposed in right angular relation for extension and retraction in their planes of movement between knit and welt positions on the cylinder and dial of the machine. The two sets of needles are aligned such that any needle can move into the space between two adjacent needles in the opposite set.

FIGS. 2 and 3 show three corresponding consecutive needle control positions 12, 14, 16 spaced sequentially along the cylinder (FIG. 2) and dial (FIG. 3) of the knitting machine in the direction of movement of the sets of needles about the cylinder and dial. FIG. 4 illustrates certain of the cylinder and dial needles throughout the three control positions 12, 14, 16 with the ground and inlay yarns engaged and operated on by the needles to form the fleece fabric of FIG. 1. As illustrated, the cylinder needles 20, **20*a* are shown in side elevation view in FIG. 2 (with corresponding dial needles seen in end view presentation), and the dial needles 22, 22*a* are shown in top, or plan, view in FIG. 3 (with corresponding cylinder needles seen in end view presentation). The positions of the latch needles of the cylinder and dial are respectively controlled by adjustable cams located along two cylinder cam tracks 30, 31 and two dial cam tracks 34, 35 of the machine, the use of such cam tracks being well known in the art. The butts of alternate, or even numbered, needles 20, 22 of the cylinder and dial sets, respectively, are engaged and controlled by the cams in one cam track of the cylinder and dial, while the butts of the intervening, or odd numbered, cylinder and dial needles 20*a*, 22*a*** are controlled by the cams in the other respective cam tracks of the cylinder and dial, as is also well known in the art. Additional cam tracks and/or jacquard patterning controls may be utilized depending on the particular type and construction of knitting machine employed to carry out the method of knitting hereinafter described. However, for simplicity of illustration, the method will be described in reference to use of only two cam tracks for each set of needles.

The first needle control position 12 includes a first yarn feed position 18 for directing a heavy fleece-type inlay yarn 19 (FIGS. 2 and 4) to selected alternate cylinder and dial needles 20, 22, respectively, of the machine, while second needle control position 14 includes a second yarn feed position 24 (FIG. 4) for directing a relatively lightweight yarn 26 to all dial needles 22, **22*a* of the machine for forming the knit ground construction. The third needle control position 16 is employed for clearing and releasing the inlay yarn 19 held by the cylinder needles 20** into the knitted ground construction to be laid alternately over and tucked under wales of the knit ground without forming stitches therein.

As is known in the art of knitting with latch needles, yarns held on the needles during a knitting operation serve the function of opening and closing the latches of the needles during needle movement to knit and welt, or fully extended and retracted, positions, respectively, of the knitting cycle. It is also known that in certain knitting operations, such as in loop transfer patterning, the latches of the needles may be opened without yarn assistance by mechanical latch openers which physically engage the latches of the needles when the needles are extended to knit, or clear, positions by their cam mechanisms. Typical of such a latch opener is a simple curved metal finger which is mounted on the cylinder or dial in a position so that the tip of the finger passes into the closed hooks of the needles, and contacts their latches to pull them open as the needles pass that point along the cylinder or dial of the knitting machine.

Referring more particularly to FIG. 2, as selected alternate latch cylinder needles 20, which contain no yarn thereon, approach inlay yarn feed position 18, they are extended to a yarn-receiving position, e.g., a tuck or a knit position (illustrated as knit position in FIGS. 2 and 4), by swing control cam surface 30*a* in upper cylinder cam track 30, while the intervening cylinder needles 20*a* are not moved from their fully retracted welt position below the height 20*c* of the cylinder. As seen, intervening cylinder needles 20*a* remain in such welt position and do not engage yarn throughout the three needle control positions 12, 14, 16 illustrated in FIG. 2. The cylinder needles 20 in knit position, and with their hooks facing outwardly as shown in FIGS. 2 and 4, are engaged by a curved finger latch opener mechanism, illustrated schematically at 32 in FIG. 2, which opens the latches (not shown) of the extended cylinder needles. The open latch needles 20 then pass first yarn feed position 18 where a heavy fleece-type inlay yarn 19 (FIG. 4) is fed by suitable tubular feed means 23 (FIG. 2) to the open hooks of the selected alternate cylinder needles 20 and the open hooks of alternate dial needles 22 (FIG. 3) which contain a ground yarn stitch thereon and are brought to an intermediate, or tuck position by a swing cam 34*a* of dial cam track 34, so that the ground yarn stitches open the latches thereof. As seen in FIGS. 3 and 4, all of the dial needles 22, 22*a* are employed to engage and knit a ground yarn of the ground construction, and all contain a previously knit loop stitch of the ground construction (FIG. 4) thereon; however, at inlay yarn feed position 18, intervening dial needles 22*a* are maintained by their cam track 35 at welt, or fully retracted, yarn position behind dial edge 22*c*.

In comparing the positions of the cylinder and dial needles in FIGS. 2–4, it can be observed that the selected cylinder needles 20 which are extended to a yarn-receiving position, with latches opened by latch opener 32 to receive inlay yarn 19, are selected to that at least one extended cylinder needle is located between each adjacent pair of extended tuck-positioned dial needles 22 to engage and pull the inlay yarn below the plane of movement of the retracted intervening dial needles 22*a* as the needles move to second yarn feed position 24. As the extended cylinder and dial needles 20, 22 leave the first yarn feed position 18, they are retracted by their respective cam tracks 30, 34 to dispose the inlay yarn in a generally sinuous path extending over the tuck-positioned dial needles 22 and under the hooks of cylinder needles 20, with the inlaid yarn 19 being pulled down and held by the cylinder needles at a position below the plane of movement of the intervening dial needles 22*a* (FIGS. 2 and 4).

As seen in FIG. 2, the lowermost surfaces 36*a* through 36*d* of the stitch and guard cams which engage the butts of the cylinder needles 20 as they pass into and through positions 14 and 16, are raised, or foreshortened, to lie above full welt position, as illustrated by cam surfaces 37, by a distance, d. Thus, the inlaid yarn 19 is not pulled down below the cylinder height 20*c* to full welt position in the cylinder, but are retracted a sufficient distance to clear the paths of movement of the intervening dial needles 22*a*. By shorting the cylinder needle 20 pull down of the inlay yarn 19 to a position above full welt, the needles 20 can accommodate inlay yarns of larger size than would be possible on the particular gauge, or cut, of the circular knitting machine which accommodates the lighter ground yarn 26. If such inlay yarns are retracted below cylinder height 20*c* to a full welt position, the size of the yarns entering the cylinder tricks, or notches, places undue stress on the yarns and needles, causing excessive wear, breakage of the needles, or breakage of the inlay yarn due to forces produced thereon.

Referring further to FIGS. 2 and 3, as the cylinder and dial needles move from first feed position 18 to second yarn feed position 24, the tuck-positioned dial needles 22 and the intervening dial needles 22*a* all are extended by swing cams 38 in their dial needle cam tracks 34, 35 to full knit position to receive the lightweight ground yarn 26 into the hooks thereof (FIG. 4). At feed position 24, the cylinder needles 20 holding the inlay yarn are maintained by their cam track 30 in their retracted, yarn miss positions slightly above the cylinder, such that the inlay yarn 19 lies alternately above and below the hooks of the dial needles 22, 22*a* engaging ground yarn 26.

As the cylinder and dial needles leave the second yarn feed position 24, all dial needles are retracted by their stitch cam surfaces to a welt position, thus forming stitches in the ground yarn construction while releasing the heavy inlay yarn 19 from the previously tuck-positioned dial needles 22 to be tucked in the ground construction without themselves forming stitches therein. The cylinder needles 20 holding the inlay yarn 19 are still retained in their retracted position to hold the inlay yarn as stitches are formed on each dial needle in the ground construction.

As the cylinder and dial needles approach third needle control position 16, all dial needles containing ground yarn stitches thereon are maintained in welt position while the cylinder needles 20 holding the inlay yarn 19 are extended to a knit position and thereafter retracted to full welt position by swing 39 cam and switch cam 40 to clear and release the inlay yarn into the knit ground construction without forming stitches therein.

In producing the fleece fabric construction shown in FIG. 1 of the drawings (wherein the inlaid yarns alternately are out of phase by one wale of the ground construction from course to course), it can be understood that in the next three needle control positions about the cylinder and dial of the knitting machine, the operation of the alternate and intervening cylinder and dial needles are controlled in reverse by the needle control cams, with needles 20, 22 being maintained in welt position at the inlay yarn feed position, and with alternate cylinder and dial needles 20*a*, 22*a*, being employed to perform the inlay method described.

Thus it can be seen from the foregoing description of the operation of the cylinder and dial needles of the knitting machine through three consecutive needle control positions, with inlay and ground yarn feeds at the first and second positions, respectively, produces a fleece fabric having a single knit jersey ground construction with heavier yarns inlaid and tucked therein to extend alternately over and under stitches of adjacent wales of the ground construction to lock the same therein. The use of the selected cylinder needles to pull the inlay yarn down and in front of the knit ground construction also disposes the heavy surface effect inlay yarn primarily on one face of the lighter knit ground fabric to provide the surface appearance desired.

Although as illustrated in FIGS. 2 and 3, the ground construction is knitted solely on the dial needles and the cylinder needles are employed only to inlay the heavier yarn in the ground construction, it can be appreciated that the use of the cylinder and dial needles may be reversed, with the cylinder needles operating on the ground yarn to form the knit ground construction, and the set of dial needles being used solely to inlay the heavier yarn therein.

Similarly, although FIGS. 1–4 illustrate production of a fleece fabric wherein the heavy inlaid yarn passes alternately over and tucked under each adjacent wale of the ground construction (every other dial needle on the dial being presented in a tuck position and only one intervening dial needle being maintained at a welt position), the method and apparatus of the present invention may be employed to produce other fleece fabric constructions wherein the inlaid yarn passes alternately over and tucks under groups of consecutive wales of the ground fabric. For example, one or several consecutive tuck-positioned dial needles may be separated by one or several consecutive welt-positioned dial needles at the inlay yarn feed position, it only being necessary to ensure that intervening cylinder needles are selected to hold the inlay yarn below the plane of movement of the welt-positioned dial needles during their subsequent knitting movement to form stitches in the ground construction. Other needle control means, such as additional cam tracks, jacquard controls, or various needle arrangements known in the art could be employed to provide the necessary control of the needles to produce the pattern desired in the fabric.

If it is not desired to inlay a heavy fleece yarn in every course of the fleece fabric, the dial needles may be selected to knit one or more consecutive additional courses before the introduction of an inlay yarn. If the fleece fabric pattern is to have an inlay yarn every other course in the ground, an additional ground yarn may be introduced only to the dial needles at third needle control position 16 as the cylinder needles move to welt position to release the heavy inlaid yarn into the knit ground stitches of the preceding course. Obviously additional courses containing no inlaid yarns may be knitted in the fabric by exclusive use of the dial needles to operate on the ground yarn without feeding of an inlay yarn thereto.

Although the method of the present invention has been described in reference to double knit machines employing latch needles in both cylinder and dial, the method may be performed on a knitting machine employing one set of latch needles for knitting the ground construction, and a set of reversed hook needles, similar to those described in aforementioned U.S. Pat. No. 3,874,197. In such case, it will be unnecessary to utilize a latch opener for the reverse hook set of needles and the third needle control position 16 can be eliminated, since the heavy inlay yarn will be automatically released from the reverse hook needles into the knit ground as they are raised to receive the inlay yarn at the next yarn feed position.

The method and apparatus of the present invention is applicable to other type knitting machines having two sets of angularly disposed needles used to knit a double-faced fabric, such as a V-bed knitting machine, with the needle control means being adapted accordingly to produce the method of operation outlined above.

That which is claimed is:

1. A knitting machine for producing a fleece fabric having a relatively light single knit ground construction and unknitted relatively heavy yarns inlaid and tucked in selected courses thereof to extend alternately over and under spaced groups of one or more consecutive wales of the ground construction, said machine including two sets of hook needles positioned for extended and retracted movement in planes disposed at angles to each other to form a fabric construction, a first yarn feed position along the sets of needles of the machine; needle control means for extending selected groups of one or more consecutive needles of one of said sets which are spaced by at least one intervening of said set to a tuck position at said first yarn feed position while maintaining said intervening needles in welt position; needle control means for selectively extending at least one needle of the other set of needles which is located between each of said groups of tuck positioned needles to a yarn receiving position at said first yarn feed position; means for introducing a relatively heavy inlay yarn into the hooks of said extended needles of both sets at said first yarn feed position; needle control means for thereafter retracting the extended needles of both sets to dispose the inlaid yarn in a sinuous path extending alternately on opposite sides of said plane of movement of said one set of needles;

a second yarn feed position along the sets of needles, needle control means for extending the previous tuck positioned needles and at least one of said intervening needles between each of said groups of tuck positioned needles of said one set to a knit position at said second yarn feed position while maintaining said other set of needles in a retracted yarn miss position with said selected needles thereof holding said heavy inlaid yarn out of the plane of movement of said intervening needles of said one set, means for feeding a relatively lightweight ground yarn to the hooks of each of said knit positioned needles in said one set at said second yarn feed position, needle control means for moving said knit positioned needles to a welt position to form corresponding stitches in said ground yarn while simultaneously releasing said inlay yarn from said previously tuck positioned needles to tuck the same into said ground yarn stitches without forming a stitch therein; and needle control means for thereafter moving said selected of said other set of needles to a knit position and then to a welt position to clear and release the inlaid yarn from said needles into the knitted ground construction without forming a stitch therein.

2. A machine according to claim 1 wherein said two sets of needles are latch needles and said needle control means at said first feed position includes means for opening the hooks of said selected extended needles of said other set for receipt of said heavy yarn from said means for feeding the heavy yarns to the hooks.

3. A machine according to claim 1 wherein said one set of needles are latch needles and said other set of needles are reversed hook needles.

4. A machine as defined in claim 1 wherein the needle control means for retracting the selected needles of said other set of needles which hold said inlay yarn out of the plane of movement of said intervening needles of said one set comprise cam means for retracting and maintaining said selected needles at an intermediate retracted position which is less than full welt position.

5. A machine as defined in claim 4 wherein said machine is a circular double knit machine and said one set of needles are dial needles of the machine, and said other set of needles are cylinder needles of the machine, and wherein said selected needles of the cylinder which engage the inlay yarn are retracted by said cam means to hold the inlay yarn below the plane of movement of said intervening needles of the dial at a position above the cylinder height of the machine which disposes the inlay yarn primarily on one face of the ground yarn stitches.

6. A method of knitting a fleece fabric on a multi-feed circular double knit knitting machine having a set of cylinder latch needles and a set of dial latch needles selectively extendable and retractable in planes disposed at angles to each other to position the needles for receiving yarns fed thereto for incorporation into a knitted fabric construction, said fleece fabric comprising a jersey knit ground construction having unknitted relatively heavy inlaid yarns extending along selected courses and pass alternately over and being tucked under selected wales of the ground construction, said method comprising the steps of:

(a) extending selected spaced groups of one or more needles of one set of needles having a ground yarn stitch held thereon to tuck positions while maintaining intervening needles of said one set at yarn miss positions;

(b) extending selected needles of the other set of needles having no yarn thereon to yarn receiving positions between said spaced groups of tuck-positioned needles and opening the latches of the needles;

(c) feeding a relatively heavy inlay yarn to the hooks of the thus extended needles of said sets;

(d) retracting said extended needles of said sets to dispose the inlaid yarn held thereon in a sinuous path about said retracted needles and at one side of the plane of movement of said intervening needles of said one set;

(e) extending the previously tuck positioned needles and at least one intervening needle of said one set containing a ground yarn stitch thereon and which lies between each of said groups of tuck-positioned needles to a knit position while maintaining the needles of said other set of yarns at said retracted position;

(f) feeding a relatively lightweight ground yarn to the hooks of said extended needles of said one set;

(g) retracting said needles containing said ground yarn to a welt position to form corresponding knit stitches in the ground yarn while releasing the inlay yarn from said previously tuck-positioned needles to tuck the same into the ground yarn stitches without forming a stitch therein; and (h) thereafter moving said selected needles of said other set of needles holding the inlaid yarn to a knit position and then to a welt position to clear and release the inlay yarn from said selected needles into the course of ground yarn stitches without forming a stitch therein.

7. A method as defined in claim 6 wherein said selected extended needles of said one set of yarns holding the inlay yarn are not fully retracted in step (d) to a welt position.

8. A knitting machine for producing single knit fleece fabrics and having two sets of needles positioned for extended and retracted movement in planes disposed at angles to each other;

(a) first needle control means on said machine, said first needle control means including first control means for extending spaced groups of one or more needles of one of said sets to a tuck position while maintaining intervening needles between said spaced groups in said set in a welt position; second control means for extending selected needles of the other set of needles which are located between said tuck-positioned groups of needles of said one set to yarn receiving positions; means for feeding a relatively heavy yarn to the hooks of said extended needles of both sets; and third control means for retracting said extended needles of both sets to dispose the yarn held in the hooks thereof in a sinuous path about the needles, with said selected needles of said other set being retracted to less than full welt position;

(b) second needle control means on said machine, said second needle control means including control means for extending said groups of previously tuck-positioned needles and at least one of said intervening needles of said one set to knit position while maintaining said selected needles of the other set at their retracted position so that the heavy yarn held in the hooks thereof is not engaged by said intervening needles when they are extended to knit position; means for feeding a relatively light yarn to the hooks of said knit positioned needles of said one set; and control means for thereafter retracting said knit positioned needles of said one set to welt position to form stitches in said light yarn while releasing said heavier yarn to tuck the same into the course of light yarn stitches without forming a stitch therein; and (c) third needle control means for thereafter moving said selected needles of said other set holding the heavy yarn in the hooks thereof to release the heavy yarn into the knitted course of light yarn without forming stitches therein.

9. A knitting machine as defined in claim 8 wherein said two sets of needles are latch needles, and said first needle control means on said machine includes means for opening the hooks of said selected extended needles of said other set for receipt of said heavy yarn from said means for feeding the heavy yarn to the hooks.

10. A knitting machine as defined in claim 8 wherein said first control means of said first needle control means comprises cam means for extending every other needle of said one set of needles to tuck position while maintaining each intervening needle therebetween at said welt position; said second needle control means comprises cam means for selectively extending every other needle of said other set to yarn receiving position between each of said tuck-positioned needles while maintaining intervening needles of the other set at welt position whereby the heavy yarn is drawn into a sinuous path about said needles to place the heavy yarn alternately on opposite sides of the plane of movement of every other needle of said one set of needles.

11. A knitting machine as defined in claim 8 wherein said two sets of needles are latch needles, said first needle control means includes means for engaging the latches of said selected extended needles of said other set of needles which are located between said tuck-positioned needles of said one set to open the latches for receipt of said heavy yarn in the hooks thereof from said feeding means; and wherein said third needle control means on said machine includes cam means for moving said selected needles of said other set to a knit position and then to a welt position to clear and release the heavy yarn into the knitted course of the lighter yarn without forming stitches therein.

12. A method of knitting a fleece fabric on a double knit machine having two sets of needles positioned for extended and retracted movement in planes disposed at angles to each other, comprising the steps of:

(a) operating on a relatively light ground yarn exclusively with one set of the needles to knit a single knit jersey ground construction exclusively on said one set of needles, while (b) operating on a relatively heavy yarn with selected ones of both sets of needles to inlay the heavy yarn to lie alternately in front of and be tucked behind groups of one or more consecutive wales of the ground construction along selected courses thereof to secure the inlay yarn in the ground construction without forming loop stitches in the yarn, and while (c) drawing the inlay yarn primarily to one face of the ground fabric by movement of said selected ones of the needles of the other set to a retracted position which is less than welt position of the set.

13. A method as defined in claim 12 wherein said two sets of needles are latch needles, and including the step of engaging said selected ones of said other set of needles to open the latches thereof prior to operating on the heavy yarn, to thereby expose the hooks of said ones of said needles for receipt of the heavy yarn.

14. A method as defined in claim 12 wherein said one set of needles are latch needles and said other set of needles are reverse open hook needles positioned with the hooks thereof disposed in facing relation to said one set of needles to receive said heavy yarn in said selected ones of the needles thereof.

15. A method as defined in claim 12 wherein said heavy yarn is operated on by selected groups of one or more consecutive needles of said one set which are separated along said set by one or more intervening needles of said one set, and wherein said heavy yarn is operated on by selected ones of said other set of needles which are located at positions between the selected groups of said one set of needles to dispose the heavy yarn in a sinuous path by movement of said needles to lie alternately on opposite sides of the plane of movement of said one set of needles during their knitting cycle.

* * * * *

UNITED STATES PATENT AND TRADEMARK OFFICE

CERTIFICATE OF CORRECTION

PATENT NO. : 4,244,197

DATED : January 13, 1981

INVENTOR(S) : Klaus P. Althammer

It is certified that error appears in the above-identified patent and that said Letters Patent are hereby corrected as shown below:

Column 6, line 48, after "swing", delete "39"; after "cam", insert--39--; line 49, "switch" should read--stitch--.

Column 8, line 23, claim 1, after "intervening", insert --needle--.

Signed and Sealed this

*Seventh* Day of *April 1981*

[SEAL]

*Attest:*

RENE D. TEGTMEYER

*Attesting Officer*

*Acting Commissioner of Patents and Trademarks*